US007045946B2

(12) United States Patent
Kawase et al.

(10) Patent No.: US 7,045,946 B2
(45) Date of Patent: May 16, 2006

(54) FLUORESCENT LAMP

(75) Inventors: Satoshi Kawase, Hadano (JP); Yoshihiko Morishita, Hadano (JP); Shigeru Kawaguchi, Hadano (JP)

(73) Assignee: Daia Keiko Co., Ltd., Tokyo (JP)

( * ) Notice: Subject to any disclaimer, the term of this patent is extended or adjusted under 35 U.S.C. 154(b) by 222 days.

(21) Appl. No.: 10/686,115

(22) Filed: Oct. 14, 2003

(65) Prior Publication Data

US 2004/0135489 A1 Jul. 15, 2004

(30) Foreign Application Priority Data

Dec. 18, 2002 (JP) ..... 2002-366251
May 20, 2003 (JP) ..... 2003-141919

(51) Int. Cl.
*H01J 1/62* (2006.01)

(52) U.S. Cl. ..... 313/493; 313/573; 313/634

(58) Field of Classification Search ..... 313/493, 313/573, 634, 234, 607, 594, 17, 25
See application file for complete search history.

(56) References Cited

U.S. PATENT DOCUMENTS 2,512,282 A * 6/1950 MacGregor ..... 313/117
4,950,053 A * 8/1990 Haim et al. ..... 349/70

* cited by examiner

*Primary Examiner*—Edward J. Glick
*Assistant Examiner*—Elizabeth Keaney
(74) *Attorney, Agent, or Firm*—Jordan and Hamburg LLP

(57) ABSTRACT

By hiding at least blackened portions from outside to make visual confirmation thereof impossible, a fluorescent lamp keeps its clean outward appearance until its service life expires and insufficiency of luminance on ends of the fluorescent lamp is dissolved. The fluorescent lamp comprising a plurality of discharging electrodes in a glass tube, and wherein the glass tube comprises an illuminating glass tube portion coated at inner wall surfaces thereof with a fluorescent substance and functioning as an illuminating body, and auxiliary glass tube portions provided contiguous to the illuminating glass tube portion and hidden from outside by shielding members, and wherein the discharging electrodes are not provided in the illuminating glass tube portion but mounted in the auxiliary glass tube portions.

6 Claims, 3 Drawing Sheets

PRIOR ART

FLUORESCENT LAMP

BACKGROUND OF THE INVENTION

The present invention relates to a tube type fluorescent lamp, in which prevention of blackening of tube ends provided with discharging electrodes is achieved and the same luminance as that on a general portion of the lamp is obtained also on ends of the lamp.

Conventionally, a straight tube type fluorescent lamp 50 shown in FIG. 4 is frequently used for illumination in an interior of a room, showcase, show window, or the like. The fluorescent lamp 50 of this kind is normally constructed such that caps 52 provided with two pins 53, 53 are provided on both ends of a glass tube 51 in the form of a straight tube. A fluorescent paint is coated on an inner wall surface of the glass tube 51, the interior of the tube is filled with mercury vapor as well as an inert gas such as argon gas or the like, discharging electrodes are provided at ends of the tube to be electrically connected to the pins 53, electrons emitted from the discharging electrodes strike against mercury vapor to produce electric discharge, and ultraviolet rays discharged excite the fluorescent paint to make the same emit light.

[Patent Document 1]

JP-A-63537

With fluorescent lamps, however, when lighting time elapses, there is caused a sputtering phenomenon, that is, a phenomenon that electrodes are gradually consumed and scattered to adhere to tube walls of a glass tube together with a charged substance, thereby blackening glass tube ends. Although such blackening phenomenon 54 shows signs of a service life of a concerned fluorescent lamp, a lighting fitting, in which a fluorescent lamp is arranged to be exposed directly outside, involves a problem that such blackening phenomenon worsens attractiveness.

Meanwhile, since a fluorescent lamp has a discharging characteristic to be increased in brightness from positions somewhat distant from discharging electrodes, tube ends darken relatively as compared with a general portion of the lamp. Further, since tube ends of a fluorescent lamp are provided with caps, dark portions increase. In connection with the problem that tube ends of a fluorescent lamp darken, Patent document 1 describes an invention of a fluorescent lamp, which comprises electron emitting portions for emitting electrons, and support portions supporting the electron emitting portions, the electron emitting portions and the support portions being arranged in the vicinity of ends of the fluorescent lamp and in which the support portions are bent toward the ends of the fluorescent lamp to make the electron emitting portions close to the ends, thus ensuring luminance on the end sides. Also, it is described that according to the invention, the support portions are bent toward the ends, whereby blackening of the ends of the fluorescent lamp is correspondingly suppressed.

Assuredly, although Patent document 1 describes the effect of suppressing blackening on the ends of the fluorescent lamp, blackening itself cannot be prevented and worsening of attractiveness is not still dissolved since blackening progresses with the lapse of time.

BRIEF SUMMARY OF THE INVENTION

Hereupon, it is a main object of the invention to prevent worsening of attractiveness due to blackening by hiding at least blackened portions from outside to make visual confirmation thereof impossible although it is impossible in a current technique from the characteristics of fluorescent lamps to prevent blackening on ends of the lamps and to provide a fluorescent lamp, in which insufficiency of luminance on ends of the fluorescent lamp can be concurrently dissolved.

To solve the above problem, the first aspect of the invention provides a fluorescent lamp comprising a plurality of discharging electrodes in a glass tube, and wherein the glass tube comprises an illuminating glass tribe portion coated at inner wall surfaces thereof with a fluorescent substance and functioning as an illuminating body, and auxiliary glass tube portions provided contiguous to the illuminating glass tube portion, and wherein the discharging electrodes are not provided in the illuminating glass tube portion but mounted in the auxiliary glass tube portions.

According to the first aspect of the invention, auxiliary glass tube portions are provided contiguous to and separate from the illuminating glass tube portion functioning as an illuminating body, and discharging electrodes are provided inside the auxiliary glass tube portions. In the case of adopting this configuration, there is a need for the construction, in which structural portions of a lighting fitting, for example, the auxiliary glass tube portions are inserted into recesses to be hidden from outside in a state of the fluorescent lamp being mounted on the lighting fitting, or the construction, in which the auxiliary glass tube portions are hidden by shielding members provided on the lighting fitting, as described later.

With the present fluorescent lamp, even when a blackening phenomenon due to sputtering occurs in the vicinity of discharging electrodes, such blackening phenomenon occurs in the auxiliary glass tube portions, and the auxiliary glass tube portions are hidden from outside, so that a fluorescent lamp can keep its outward appearance until its service life expires while it remains clean. Also, since some distances are ensured from the discharging electrodes to the illuminating glass tube portion, the characteristic, in which brightness is increased from positions somewhat distant from the discharging electrodes, is conversely made use of in fluorescent lamps, so that uniform luminance can be ensured in the illuminating glass tube portion.

Subsequently, the second aspect of the invention provides a fluorescent lamp comprising a plurality of discharging electrodes in a glass tube, and where in the glass tube comprises an illuminating glass tube portion coated at inner wall surfaces thereof with a fluorescent substance and functioning as an illuminating body, and auxiliary glass tube portions provided contiguous to the illuminating glass tube portion and hidden from outside by shielding members, and wherein the discharging electrodes are not provided in the illuminating glass tube portion but mounted in the auxiliary glass tube portions The second aspect of the invention is directed to using the shielding members to hide the auxiliary glass tube portions from outside, as contrasted with the first aspect of the invention. Accordingly, even with that lighting fitting in which a fluorescent lamp is exposed wholly, the blackening phenomenon generated in the auxiliary glass tube portions is not visually confined from outside but a fluorescent lamp can keep its outward appearance until its service life expires while it remains clean. In addition, the remaining effects are the same as those in the first aspect of the invention.

The third aspect of the invention provides the fluorescent lamp of the first and second aspects of the invention, wherein at least 10 mm or more is ensured for distances from the discharging electrodes to positions of boundaries between the illuminating glass tube portion and the auxiliary glass tube portions. Since a blackening phenomenon due to sputtering occurs frequently in the vicinity of discharging electrodes, distances from the discharging electrodes to the illuminating glass tube portion are made 10 mm or more whereby it is possible to effectively prevent the blackening phenomenon due to sputtering in the illuminating glass tube portion.

The fourth aspect of the invention provides the fluorescent lamp of the first through third aspects of the invention, wherein the auxiliary glass tube portions extend within a lengthwise dimension of the illuminating glass tube portion to be arranged in parallel along a lengthwise direction.

The fifth aspect of invention provides the fluorescent lamp of the first trough third aspects of the invention, wherein the auxiliary glass tube portions are arranged along a direction perpendicular to an axis of the illuminating glass tube portion.

The sixth aspect of the invention provides the fluorescent lamp according to the fourth aspect of the invention, wherein a filling material is filled into gaps between the auxiliary glass tube portions and the illuminating glass tube portion. Desirably, reinforcement of the auxiliary glass tube portions is achieved by filling a filling material into gaps between the auxiliary glass tube portions and the illuminating glass tube portion.

BRIEF DESCRIPTION OF THE DRAWINGS

Accompanying the specification are figures which assist in illustrating the embodiments of the invention, in which.

DESCRIPTION OF THE PREFERRED EMBODIMENTS

Embodiments of the invention will be described in detail below with reference to the drawings.

First Embodiment

Figure 1:
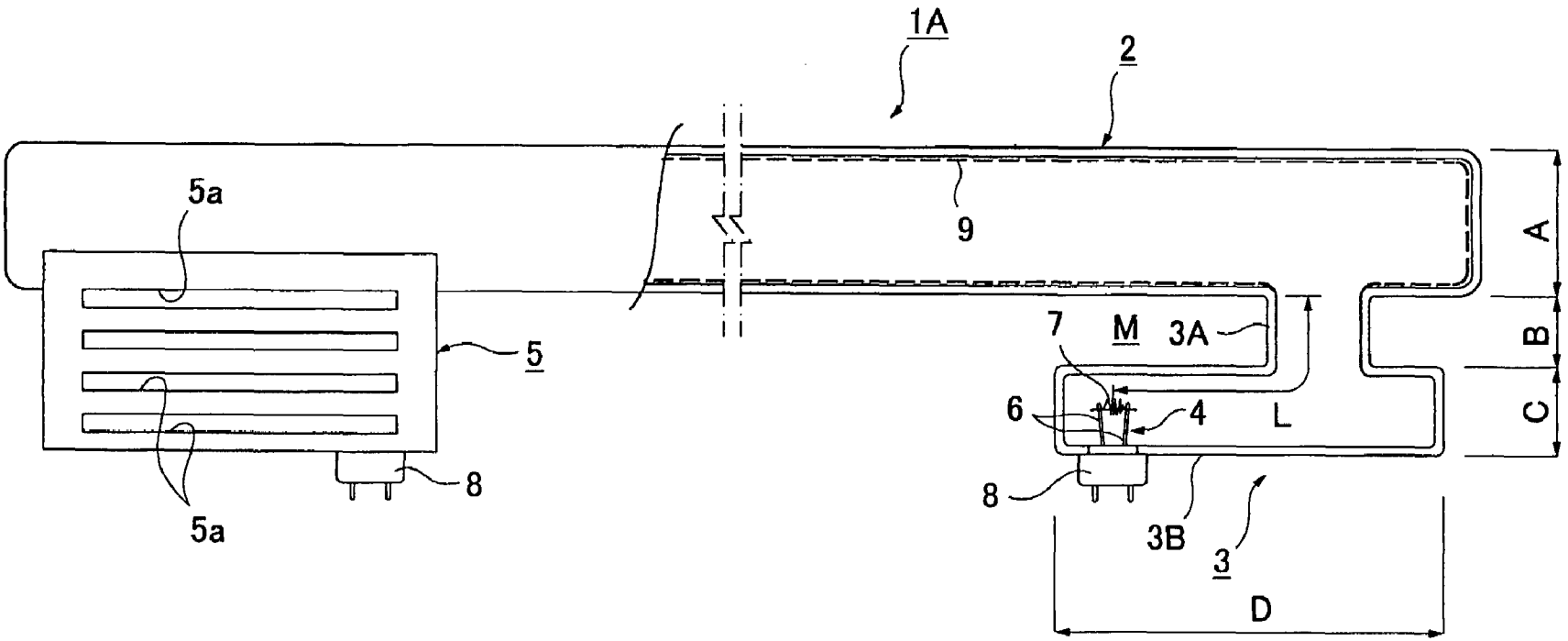
FIG. 1 is a partially fragmentary side view showing a fluorescent lamp 1A according to a first embodiment of the invention.

FIG. 1 is a partially fragmentary side view showing a fluorescent lamp 1A according to a first embodiment of the invention.

The fluorescent lamp 1A comprises an illuminating glass tube portion 2 coated at inner wall surface thereof with a fluorescent substance 9 and functioning as an illuminating body, and auxiliary glass tube portions 3 provided contiguous to ends of the illuminating glass tube portion 2 and hided from outside by shielding members (cover members 5, or the like).

While the illuminating glass tube portion 2 corresponds to an ordinary fluorescent glass tube coated at inner wall surfaces thereof with a fluorescent substance 9, the invention specifically adopts a construction, in which discharging electrodes are not mounted in the illuminating glass tube portion 2, which functions as an illuminating body. The illuminating glass tube portion 2 has a tube diameter A of about 12 to 25 mm as in ordinary fluorescent lamps.

Since the auxiliary glass tube portions 3 provided contiguous to the ends of the illuminating glass tube portion 2 do not serve as illuminating bodies, there is no need of coating a fluorescent substance on inner wall surfaces of the tube portions but a fluorescent substance may be coated thereon for the reason in, for example, manufacture. In the example shown in the figure, the auxiliary glass lube portions 3 comprise a connection tube conduit 3A for connection to the illuminating glass tube portion 2, and a discharging electrode mount tube conduit 3B for mounting of a discharging electrode 4. Here, preferably, the connection tube conduits 3A have a length of about 1 to 5 mm, and the discharging electrode mount tube conduits 3B have a tube diameter of about 6 to 20 mm and a length of about 30 to 50 mm. What is important in the constitution of such auxiliary glass tube portions 3 is to ensure that a separation L from the discharging electrode 4 mounted in the discharging electrode mount tube conduct 3B to a boundary between the illuminating glass tube portion 2 and the auxiliary glass tube portion 3 be at least 10 mm or more, preferably 15 mm or more, more preferably 20 mm or more, and still more preferably 30 mm or more. If the separation L were 10 mm or less, the blackening phenomenon even in the illuminating glass tube portion 2 due to sputtering and blackened portions would be visually confirmed from outside. As shown in a left side portion (outside drawing) of FIG. 1, cover members 5 made of stainless steel, resin, heat-resisting resin, or the like are provided on the auxiliary glass tube portions 3 to visually hide the same from outside. In the case where a stainless steel sheet or the like is used to make the cover members 5, it is desirable to provide openings 5*a* at appropriate locations as shown in the figure, thus radiating heat generated by a concerned fluorescent lamp. Also, in the case where a resin, a heat-resisting resin, or the like is used to make the cover member; 5, it is desirable to beforehand fabricate casing-shaped cover members 5 and to put and mount the cover members on the auxiliary glass tube portions 3 after the illuminating glass tube portion 2 and the auxiliary glass tube portions 3 are joined together.

Also, it is desirable to achieve reinforcement of the auxiliary glass tube portions 3 by filling a filling material such as silicone or the like at least into gaps M between the auxiliary glass tube portions 3 and the illuminating glass tube portion 2. Alternatively, a filling material such as silicone or the like may be filled wholly into internal spaces of the cover members 5. In this case, reinforcement of the auxiliary glass tube portions 3 can be surely achieved and heat is radiated from external surface of the cover members owing to thermal conduction through the filling material.

The discharging electrodes 4 comprise lead-in wires 6 and a coil filament 7 coated with oxides of alkaline earth metal or the like, and it is possible to adopt a way to mount the discharging electrodes within the auxiliary glass tube portions 3 while using various known stems such as a flare-type stem, a button stem, or the like for supports, or a way to providing sealing by crushing glass ends while melting the glass ends in a state, in which the lead-in wires are taken out, without the use of sterns. The caps 8 provided with terminals, which are electrically connected to the lead-in wires 6, can assume a shape of an optional cap selected from a bi-pin type (G type) shown in the figure and having two pins, recessed double contact type (R type), an instant start type (F type) having a single pin, or the like, prescribed in JISC7709 Standard. In the example shown, the discharging electrodes 4 are inserted and mounted in a direction (side wall surface) perpendicular to a longitudinal axis of the auxiliary glass tube portions 3, but the discharging electrodes 4 may be inserted and mounted from end surface sides of the auxiliary glass tube portions 3 as in common straight tube type fluorescent lamps.

Second Embodiment

Figure 2:
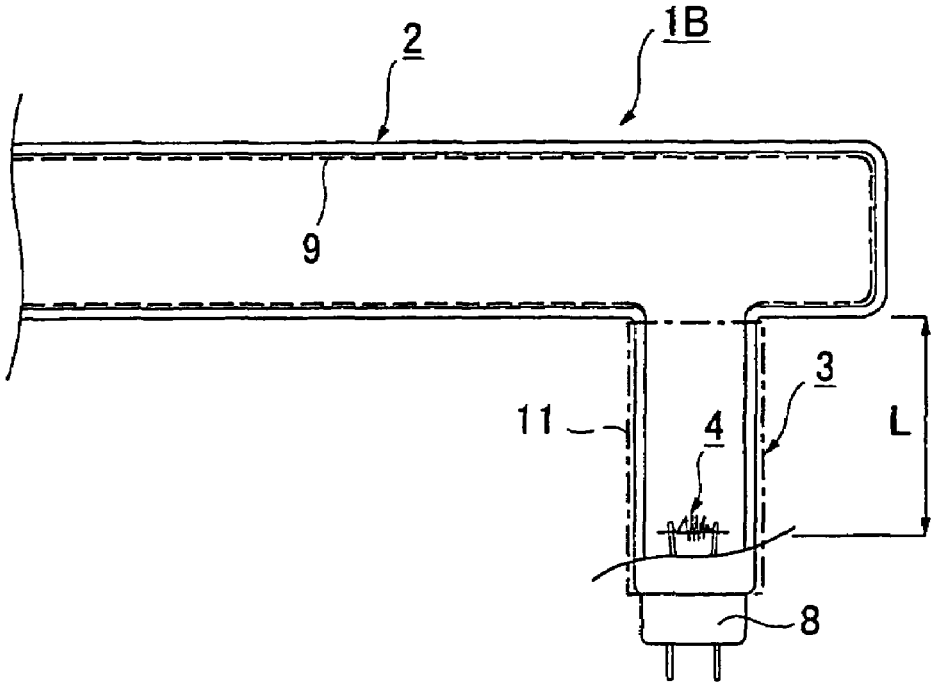
FIG. 2 is a partially fragmentary side view showing a fluorescent lamp 1B according to a second embodiment of the invention.

Subsequently, a fluorescent lamp 1B according to a second embodiment, shown in FIG. 2 constitutes an example, in which auxiliary glass tube portions 3 are connected in a direction perpendicular to an axis of an illuminating glass tube portion 2. The auxiliary glass tube portions 3 are covered by cover members 11 to be visually hidden from outside. Also, at least 10 mm or more is ensured for a separation L from a discharging electrode 4 to a boundary between the illuminating glass tube portion 2 and the auxiliary glass tube portion 3. Further, in the example shown, caps 8 of a bi-pin type with two pins are provided on ends of the auxiliary glass tube portions 3 while the caps may be of an instant start type with a single pin, or caps of a contact type may be provided on sides of the ends of the auxiliary glass tube portions 3

Although the fluorescent lamp 1B has a large dimension in a direction along a minor axis of the illuminating glass tube portion 2, the blackening phenomenon due to sputtering occurs in the auxiliary glass tube portions 3 as in the first embodiment and does not extend to the illuminating glass tube portion 2, so that the fluorescent lamp can keep its outward appearance until its service life expires while it remains clean. As for the remaining construction, the same reference numerals denote elements having the same functions as those in the first embodiment, and an explanation therefor is omitted.

Third Embodiment

Figure 3:
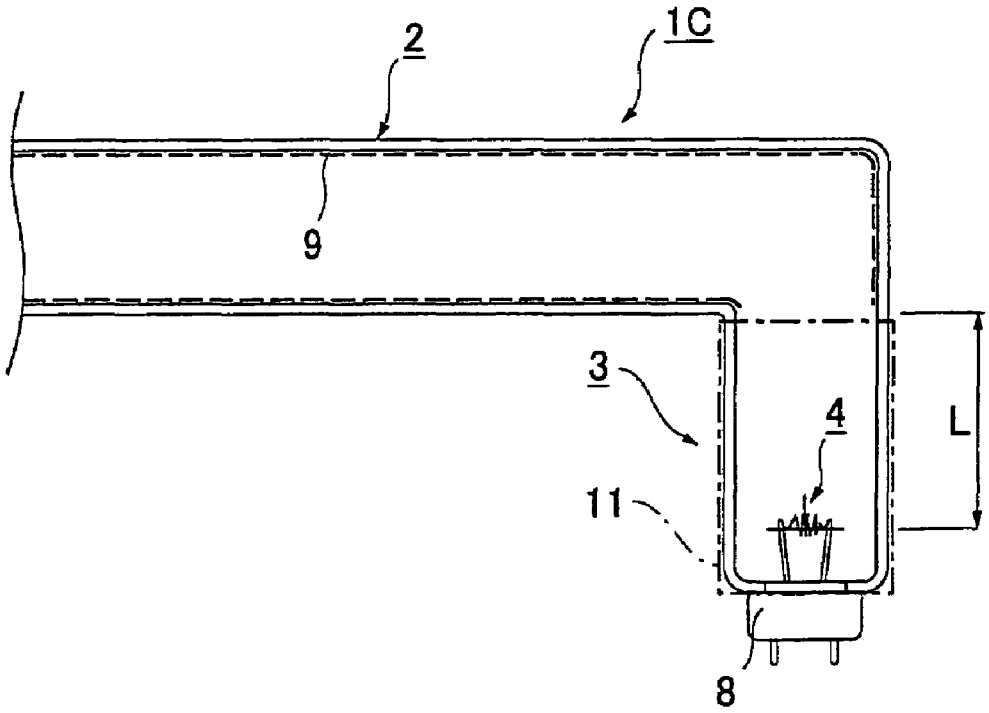
FIG. 3 is a partially fragmentary side view showing a fluorescent lamp 1C according to a third embodiment of the invention.
Figure 4:
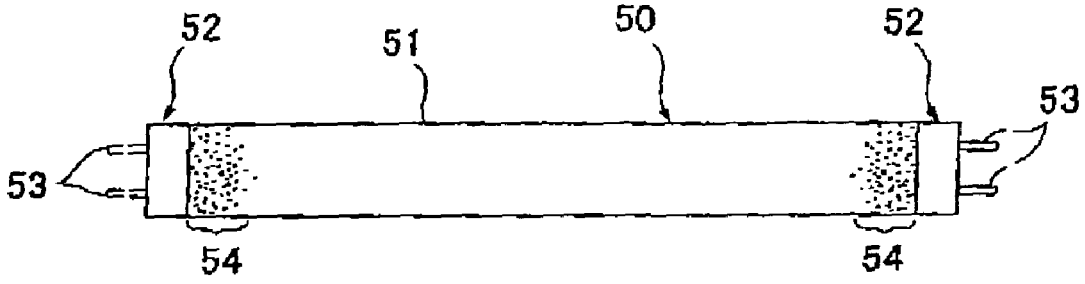
FIG. 4 is a side view showing a conventional straight tube type fluorescent lamp.

A fluorescent lamp 1C according to a third embodiment, shown in FIG. 3 constitutes an example, in which ends of an illuminating glass tube portion 2 are bent in a L-shaped manner and bent portions constitute auxiliary glass tube portions 3 provided therein with discharging electrodes 4. In this manner, the auxiliary glass tube portions 3 may be formed integral with the illuminating glass tube portion 2. As for the remaining construction, the same reference numerals denote elements having the same functions as those in the first embodiment, and an explanation therefor is omitted.

OTHER EMBODIMENTS (1) While the auxiliary glass tube portions 3 in the first to third embodiments are hidden from outside by the shielding members 5, 11, the auxiliary glass tube portions 3 may be made not to be seen from outside by the construction, from which the shielding members 5, 11 are omitted, and in which structural portions of a lighting fitting, for example, the auxiliary glass tube portions 3 are inserted into recesses to be hidden from outside in a state of the fluorescent lamp being mounted on the lighting fitting, or the construction, in which the auxiliary glass tube portions are hidden by shielding members provided on the lighting fitting, may be adopted to prevent the auxiliary glass tube portions 3 from being seen from outside.

(2) While the auxiliary glass tube portions 3 in the above embodiments are hidden from outside and thus blackened portions are not seen from outside, insufficiency of luminance on those ends of the fluorescent lamp, which are liable to darken, can be compensated for by, for example, coating a fluorescent substance on interiors of the auxiliary glass tube portions 3 and having the auxiliary glass tube portions 3 functioning as illuminating bodies.

As described above in detail, according to the invention, at east blackened portions are hidden from outside to make visual confirmation thereof impossible whereby a fluorescent lamp can keep its outward appearance until its service life expires while it remains clean. Concurrently, distances from the discharging electrodes to the illuminating glass tube portion can be ensured to dissolve insufficiency of luminance on ends of the fluorescent lamp.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

What is claimed is:

1. A fluorescent lamp including plurality of discharging electrodes in a glass tube, the glass tube comprising:

an illuminating glass tube portion coated at inner wall surfaces thereof with a fluorescent substance and functioning as an illuminating body;

auxiliary glass rube portions provided contiguous to the illuminating glass tube portion;

said auxiliary glass tube portions extending parallel to a longitudinal axis of said illuminating glass tube; and discharging electrodes not being provided in the illuminating glass tube portion but mounted in the auxiliary glass tube portions.

2. A fluorescent lamp including a plurality of discharging electrodes in a glass tube, the glass tube comprising:

an illuminating glass tube portion coated at inner wall surfaces thereof with a fluorescent substance and functioning as an illuminating body;

auxiliary glass tube portions provided contiguous to the illuminating glass tube portion and hidden from outside by shielding members;

said auxiliary glass tube portions extending parallel to a longitudinal axis of said illuminating glass tube; and discharging electrodes not being provided in the illuminating glass tube portion but mounted in the auxiliary glass tube portions.

3. The lamp of either of claims 1 or 2, wherein a filling material is filled into gaps between the auxiliary glass tube portions and the illuminating glass tube portion.

4. The lamp of claim 2 wherein said shielding member further comprises openings, said opening irradiating heat from said auxiliary glass tubes.

5. The lamp of claim 2 wherein said shielding member is formed of resin.

6. The lamp of claim 2 wherein said shielding member is formed of heat resistant resin.

* * * * *